United States Patent [19]

Taniguchi

[11] Patent Number: 4,969,918

[45] Date of Patent: Nov. 13, 1990

[54] ROTARY VALVE OPERATING MECHANISM

[75] Inventor: Masato Taniguchi, Aichi, Japan

[73] Assignee: NGK Spark Plug Co., Ltd., Nagoya, Japan

[21] Appl. No.: 403,362

[22] Filed: Sep. 6, 1989

[30] Foreign Application Priority Data

Sep. 9, 1988 [JP] Japan ..... 63-226939

[51] Int. Cl.[5] ..... F01L 7/10

[52] U.S. Cl. ..... 123/190 A; 123/81 B

[58] Field of Search ..... 123/190 A, 81 R, 81 B, 123/81 C; 251/251

[56] References Cited

U.S. PATENT DOCUMENTS

| | | | |
|---|---|---|---|
| 1,781,901 | 11/1930 | Gamache | 123/81 B |
| 2,086,705 | 7/1937 | Ellis | 123/81 B |
| 4,098,238 | 7/1978 | Vallejas | 123/81 B |
| 4,455,976 | 6/1984 | McCandless | 123/81 C |
| 4,858,577 | 8/1989 | Matsuura et al. | 123/190 A |
| 4,864,980 | 9/1989 | Riese | 123/190 A |

FOREIGN PATENT DOCUMENTS

| | | |
|---|---|---|
| 59-32608 | 2/1984 | Japan . |
| 62-203907 | 9/1987 | Japan . |

*Primary Examiner*—E. Rollins Cross

*Attorney, Agent, or Firm*—Foley & Lardner, Schwartz, Jeffery, Schwaab, Mack, Blumenthal & Evans

[57] ABSTRACT

A rotary valve is rotatable about an axis and has a port extending crosswise of the axis of rotation. A drive unit drives the rotary valve to oscillate about 180° in such a way that the rotary valve rotates in one direction into and out of the position of establishing communication between the valve port and a cylinder head port communicating with a combustion chamber.

12 Claims, 4 Drawing Sheets

INTAKE

COMPRESSION

COMBUSTION

EXHAUST

INTAKE

COMPRESSION

COMBUSTION

EXHAUST

ROTARY VALVE OPERATING MECHANISM

BACKGROUND OF THE INVENTION

1. Field of the Invention

The present invention relates in general to an internal combustion engine equipped with rotary valves and more particular to a valve operating mechanism for such an internal combustion engine.

2. Description of the Prior Art

A popet type intake or exhaust valve in an internal combustion engine involves a responsive delay due to its jumping at high-speed and is causative of surging, noise, etc. Such disadvantages can be overcome by the use of a rotary valve as is well known in the art. The rotary valve can be suitably made of ceramics since it is less liable to be subjected to an impact load as compared with the popet valve.

A prior art rotary valve operating mechanism disclosed in Japanese Patent Provisional Publication No. 59-32608 is adapted so that the valves rotate continuously in one direction. Another prior art mechanism disclosed in Japanese Patent Provisional Publication No. 62-203907 is adapted so that the valves oscilate 90° between a valve opening position and a valve closing position.

A disadvantage of the first mentioned prior art mechanism is that a difficult work is required for adjusting the rotational speed of the rotary valve in relation to the angle of rotation of the crankshaft and thereby adjusting the valve opening and closing timings in order to, for example, make the valve open for a longer period.

A disadvantage of the second mentioned prior ar mechanism is that its durability is poor. This is because the valve in a position of closing the intake or exhaust port is exposed to the gases of a high temperature and high pressure at a portion facing the combustion chamber and to the gases of a low temperature and low pressure at a portion facing an intake pipe or an exhaust pipe. Due to this, the valve is subjected to great force and heat at the particular portion repeatedly so that local fatigue and wear of the valve, excessive wear of a vavle seat and large thermal stress due to the partial heating of the valve are liable to be caused.

SUMMARY OF THE INVENTION

In accordance with the present invention, there is provided an improved rotary valve operating mechanism for an internal combustion engine having a cylinder head port communicating with a combustion chamber.

The mechanism comprises a rotary valve rotatable about an axis and having a valve port extending crosswise of the axis and alignable with the cylinder head port and drive means for driving the rotary valve to oscilate a predetermined angle in such a manner that the rotary valve rotates in one direction into and out of the oposition of establishing communication between the cylinder head port and the valve port.

The above structure is effective for overcoming the above noted disadvantages inherent in the prior art mechanisms.

It is accordingly an object of the present invention to provide an improved rotary valve operating mechanism which is reliable in operation and has an excellent durability.

It is another object of the present invention to provide an improved rotary valve operating mechanism of the above described character which can make uniform the temperature distribution in a rotary valve and thereby make the rotary valve free from local wear and fatigue.

It is a further object of the present invention to provide an improved valve operating mechanism of the above described character which can reduce the thermal stress arising in the rotary valve.

It is a further object of the present invention to provide an improved valve operating mechanism of the above described character which can prevent excessive wear of valve seats carrying the rotary valve.

It is a further object of the present invention to provide an improved valve operating mechanism of the above described character which can improve the intake and exhaust efficiencies of the associated engine.

DESCRIPTION OF THE PREFERRED EMBODIMENT

Figure 1:
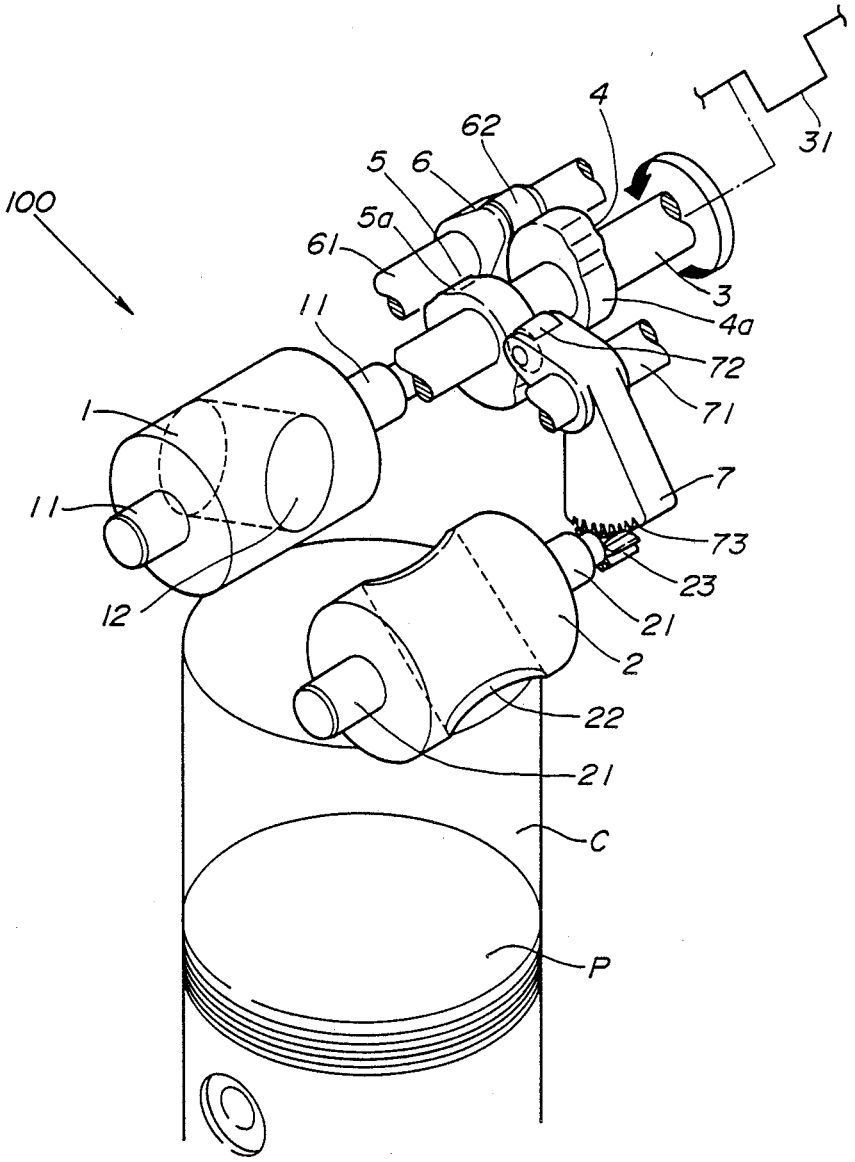
FIG. 1 is a perspective view of a rotary valve operating mechanism according to an embodiment of the present invention.

Referring to FIGS. 1, 2 and 3A–3H, a 4-stroke cycle internal combustion engine includes a cylinder C defining a combustion chamber, a piston P slidably disposed in the cylinder C, a cylinder head K and an intake port I and exhaust port 0 formed in the cylinder head K.

A rotary valve operating mechanism 100 consists of a rotary intake valve 1 installed in the cylinder head K in such a way as to be rotatable about an axis and a rotary exhaust valve 2 installed in the cylinder head K similarly to the rotary intake valve 1, a camshaft 3 connected to a crankshaft 31 by way of a belt (not shown) and rotatable in timed relation to the crankshaft with a reduction ratio of ¼ (i.e., the ratio of the rotation of the camshaft 3 to the rotation of the crankshaft 31 is ¼), and cams 4, 5 installed on the camshaft 3.

The valves 1, 2 are cylindrical and have secured thereto valve shafts 11, 21 which are arranged in parallel with the camshaft 3 and in such away as to have axes coincident with the axes of rotation of the valves 1, 2. In other words, the valve shafts 11, 21 support thereon the valves 1, 2, respectively and are rotatably installed in the cylinder head K. The valves 1, 2 are thus rotatable with the valve shafts 11, 21 about the axes of same.

The valves 1, 2 are formed with valve ports 12, 22 respectively alignable with the intake port I and exhaust port O and in such a way that the axes of the valve ports 12, 22 extend crosswise of the axes of rotation of the valves 1, 2.

The rotary valves 1, 2 are adapted to slide on annular valve seats 1*a*, 1*b*, 2*a*, 2*b* which are fixedly installed in the cylinder head K. More specifically, the valve seats 1*a*, 1*b* are spaced axially of the intake port I and have valve seat ports 1*c*, 1*d* aligned with the intake ports I. The valve seats 1*a*, 1*b* further have part-cylindrical surfaces 1*e*, 1*f* on which the valve 1 is rotatably carried. The valve seats 2*a*, 2*b* are spaced axially of the exhaust port O and have valve seat ports 2*c*, 2*d* aligned with the exhaust port O. The valve seats 2*a*, 2*b* further have part-cylindrical surfaces 2*e*, 2*f* on which the valve 2 is rotatably carried. Pinion gears 13, 23 are installed on the valve shafts 11, 21 to rotate with same and arranged in oppossition to the cams 4, 5, respectively.

Rocker arms 6, 7 are interposed between the cams 4, 5 and the pinion gears 13, 23 to drivingly interconnect the same. The rocker arms 6, 7 are swingably installed on respective rocker shafts 61, 71 in parallel with the camshaft 3 and the valve shafts 11, 21 and have at one ends rollers 62, 72 in rolling contact with cam surfaces 4a, 5a of the cams 4, 5 and at the other ends sector gears 63, 73 meshed with the pinion gears 13, 23.

The cams 4, 5, rocker arms 6, 7 and pinion gears 13, 23 constitute a valve drive train for driving the valves 1, 2 to oscillate 180° about the axes of rotation, i.e., about the axes of the valve shafts 11, 21 and thereby open and close the intake port I and exhaust port O.

Figure 2:
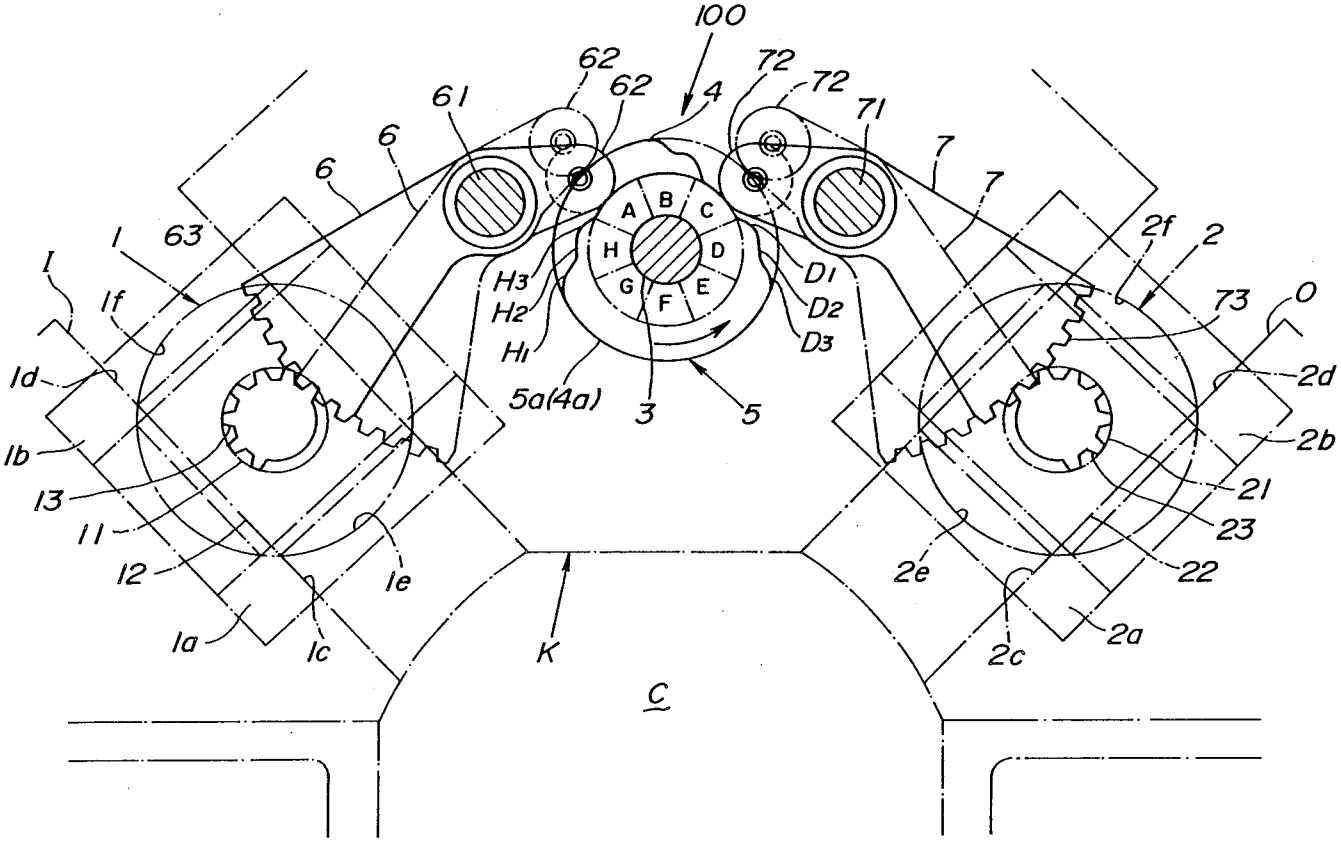
FIG. 2 is a schematic sectional view of the mechanism of FIG. 1.
Figure 3A:
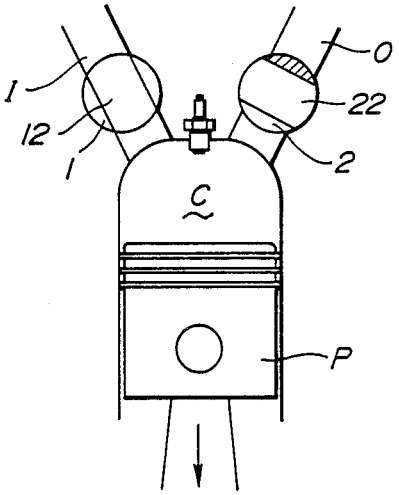
FIGS. 3A to 3H are schematic sectional views of the mechanism of FIG. 1 in its various operating positions.
Figure 3B:
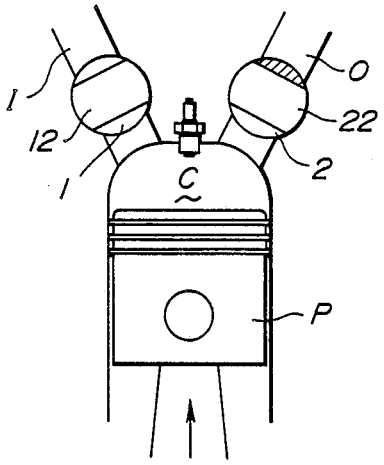
Figure 3C:
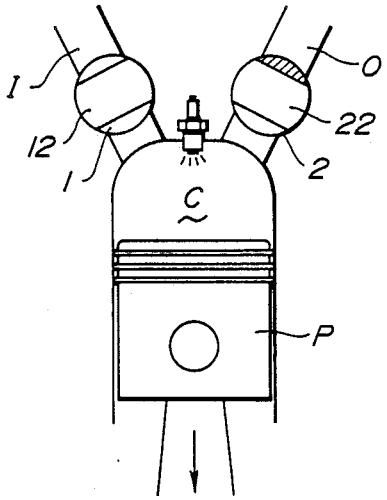
Figure 3D:
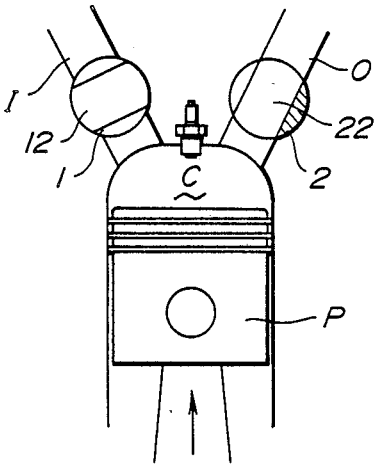
Figure 3E:
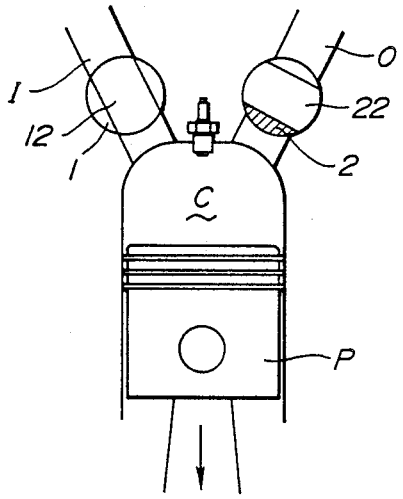
Figure 3F:
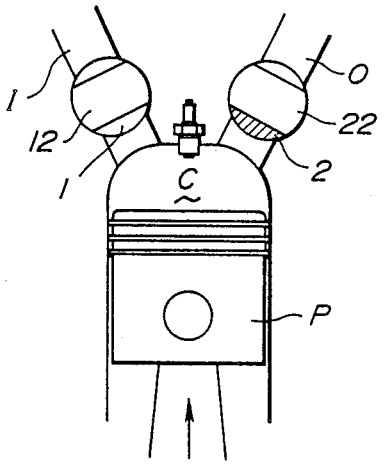
Figure 3G:
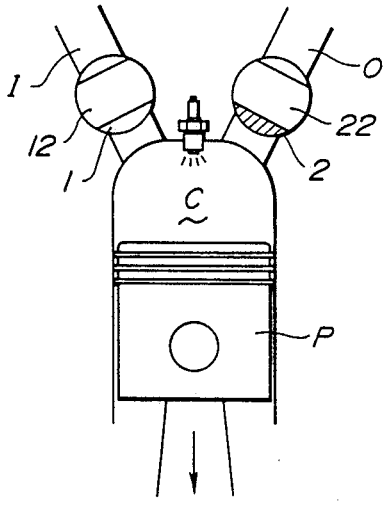
Figure 3H:
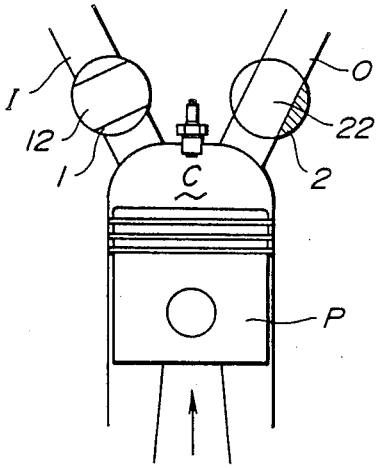

The cams 4, 5, as shown in FIG. 2, are disk cams consisting of eight angularly divided sector zones —each zone is 45°. The zones A, B, C provide a concentric circular cam surface portion of a smaller radius and the zones E, F, G provide a concentric circular cam surface portion of a larger radius. That is, the zones A, B, C and the zones E, F, G constitute dwell cam surface portions, respectively.

The zone D interconnecting the zone C and zone E provides a contoured cam surface portion including a front section D1 having a relatively high radius increasing rate, a middle section D2 having a radius increasing rate which is 0 (zero) or relatively low and a rear section D3 a relatively high radius increasing rate. That is, the zone D constitues a rise-dwell-rise cam surface portion or a rise(at high velocity)-rise(at low velocity)-rise (at high velocity) cam surface portion.

The zone H interconnecting the zone G and the zone A provides a contoured cam surface portion including a front section H1 having a relatively large radius reducing rate, a middle section H2 having a radius reducing rate which is 0 (zero) or relatively small, and a rear section H3 having a relatively large radius reducing rate. That is, the zone H constitutes a return-dwell-return cam surface portion or a return(at high velocity)-return(at low velocity)return(at high velocity) cam surface portion. The zones D, H are arranged so as to have a phase difference of 180°.

When the cam 5 rotates anticlockwise in FIG. 2, the roller 72 of the rocker arm 7 slides on the cam surface 5a. When the roller 72 rolls on the zones A, B, C, the rocker arm 7 is held stationarily at a predetermined angular position, i.e., in the solid line position in FIG. 2.

When the roller 72 rolls on the cam surface 5a further and comes in contact with the zone D, the rocker arm 7 is driven clockwise as follows. At a first stage where the roller 72 is driven by the front section D1 of the zone D, the rocker arm 7 swings clockwise at relatively high velocity. At a next or middle stage where the roller 72 is driven by the middle section D2, the rocker arm 7 stops swinging or swings at relatively low velocity. At a final stage when the roller 72 is driven by the rear section D3, the rocker arm 7 swings clockwise at relatively high velocity.

When the roller 72 rolls on the cam surface 5a further and comes in contact with the zones E, F, G, the rocker arm 7 is held stationary at a predetermined angular position, i.e., in the one-dot chain line position in FIG. 2. When the roller 72 rolls on the cam surface 5a further and comes in contact with the zone H, the rocker arm 7 is driven anticlockwise as follws. At a first stage where the roller 72 is driven by the front section H1, the rocker arm 7 swings anticlockwise at relatively high velocity. At a next or middle stage when the roller 72 is driven by the middle section H2, the rocker arm 7 stops swinging or swings anticlockwise at relatively low velocity. At a final stage when the roller 72 is driven by the rear section H3, the rocker arm 7 swings anticlockwise at relatively high velocity.

The reason why the rocker arm 7 is adapted to stop swinging or swing at relatively low velocity at the middle stage is for controlling the period during which the valve port 22 is largely communicated with the exhaust port 0 in order to obtain smooth exhaustion and improve the exhaust efficiency. A similar control applied to the rocker arm 6 for the intake valve 1 is effective for increasing the intake efficiency and therefore the engine output.

In the above manner, the rocker arm 7 oscilates between the predetermined positions. The oscilation of the rocker arm 7 is transferred through the sector gear 73 to the pinion gear 23. The sector gear 73 and the pinion gear 23 are constructed so that the oscilation of the rocker arm 7 between the predetermined positions causes the pinion gear 23 to oscillate 180°.

The camshaft 3 rotates in timed relation to the crankshaft as shown in table 1 for opening and closing the intake and exhaust ports I, 0.

TABLE 1

| EXHAUST SIDE CAM POSITION | STROKE | CRANK ANGLE (°) | CAM ANGLE (°) |
|---|---|---|---|
| A | INTAKE | 180 | 45 |
| B | COMPRESSION | 360 | 90 |
| C | COMBUSTION | 540 | 135 |
| D | EXHAUST | 720 | 180 |
| E | INTAKE | 900 | 225 |
| F | COMPRESSION | 1080 | 270 |
| G | COMBUSTION | 1260 | 315 |
| H | EXHAUST | 1440 | 360 |

The operation of the rotary valve operating mechanism will be described with respect to the exhaust side and with reference to FIGS. 3A to 3H.

First cycle (A) Intake stroke:

The roller 72 of the rocker arm 7 rolls on the zone A of the cam surface 5a. The valve 2 is held stationarily in the position of closing the exhaust port O while directing the hatched side to the atomosphere (exhaust pipe).

(B) Compression stroke:

The roller 72 of the rocker arm 7 rolls on the zone B of the cam surface 5a. The valve 2 is held stationarily in the position of closing the exhaust port O.

(C) Combusion stroke:

The roller 72 of the rocker arm 7 rolls on the zone C of the cam surface 5a. The valve 2 is held stationarily in the position of closing the exhaust port O.

(D) Exhaust stroke:

The roller 72 of the rocker arm 7 rolls on the zone D of the cam face 5a. The valve 2 rotates 90° clockwise in FIG. 2 and opens the exhaust port O. The valve 2 then holds this condition for a while and then further rotates 90° clockwise in FIG. 2 to close the exhaust port O again. At the end of this stroke, the hatched side of the valve 2 is positioned so as to face the combustion chabmer.

Second cycle (E) Intake stroke:

The roller 72 of the rocker arm 7 rolls on the zone E of the cam surface 5a. The valve 2 is held stationarily in the position of closing the exhaust port O while directing the hatched side to the combustion chamber.

(F) Compression stroke:

The roller 72 of the rocker arm 7 rolls on the zone F of the cam surface 5a. The valve 2 is held stationarily in the position of closing the exhaust port O.

(G) Combustion stroke:

The roller 72 of the rocker arm rolls on the zone G of the cam surface 5a. The valve 2 is held stationarily in the position of closing the exhaust port O.

(H) Exhaust stroke:

The roller 72 of the rocker arm 7 rolls on the zone H of the cam surface 5a. The valve 2 rotates 90° anticlockwise and opens the exhaust port O. The valve 2 holds this condition for a while and then further rotates 90° anticlockwise in FIG. 2 to close the exhaust port O again. At the end of this stroke, the hatched side of the valve 2 is directed to the atomosphere (exhaust pipe).

In this manner, the valve 2 is subjected at two diameterically opposed sides or portions to a high pressure and heat from the combustion chamber, thus making it possible to attain a uniform temperature distribution, reduce the thermal stress and prevent the local fatigue and wear.

The operation of the valve operating mechanism with respect to the intake side will be selfexplanatory and is therefore omitted for brevity.

While the embodiment of the present invention has been described and shown as above, it is not limitive. For example, the oscillating range of the valve is not limited to 180° but may be varied within the range of 135° to 225° depending on the size of the exhaust port and the diameter of the valve.

Further, the valve is not limited to a cylinderical shape but may be a shape obtained by rotating various plane figures other than the cylindrical shape.

Further, the material forming the valve is not limited to ceramics including silicon nitride, alumina, etc. but may be a heat resisting metal other than ceramics. Further, the valve may be made of ceramics at only the portion to be held in opposition to the combustion chamber and the support shaft portion may be made of metal.

What is claimed is:

1. A rotary valve operating mechanism for an internal combustion engine having a cylinder head port communicating with a combustion chamber, comprising:

a rotary valve rotatable about an axis and having a valve port extending crosswise of said axis and alingable with said cylinder heat port; and drive means for driving said rotary valve to oscillate a predetermined angle in such a manner that said rotary valve rotates in one direction to sequentially establish and obstruct communication between said cylinder head port and said valve port.

2. The rotary valve operating mechanism according to claim 1, wherein said drive means is operable to drive said rotary valve to rotate in another direction opposite to said one direction to sequentially establish and obstruct communication between said cylinder head port and said valve port.

3. The rotary valve operating mechanism according to claim 2 wherein said predetermined angle is between 135° to 225°.

4. The rotary valve operating mechanism according to claim 3, wherein said drive means comprises a cam rotatable in timed relation to a crankshaft and a rocker arm interposed between said cam and said rotary valve and being swingably driven by said cam to drive said rotary valve to oscillate, said cam being a disk cam of a dwell-rise-dwell-return cam surface consisting of a first dwell cam surface portion for obstructing said communication, a rise cam surface portion for establishing said communication, a second dwell cam surface portion for obstructing said communication, and a return cam surface portion for establishing said communication.

5. The rotary valve operating mechanism according to claim 4, wherein said rise cam surface portion is shaped so that said rotary valve rotates at a reduced velocity when coming near a position where said valve port is aligned with said cylinder head port.

6. The rotary valve operating mechanism according to claim 5, wherein said return cam surface portion is shaped so that said rotary valve rotates at a reduced velocity when coming near a position where said vale port is aligned with said cylinder head port.

7. The rotary valve operating mechanism according to claim 6, wherein said engine is a 4-stroke cycle engine and said first dwell cam surface portion is a concentric circular cam surface of a relatively small radius extending over a sector zone of 135°, said rise cam surface portion extending over a sector zone of 45° and consisting of a front section increasing in radius at a relatively high rate, a middle section increasing in radius at a relatively low rate, and a rear section increasing in radius at a relative high rate, and wherein said second dwell cam surface portion is a concentric circular cam surface of a relatively large radius extending over a sector zone of 135°, said return cam surface portion extending over a sector zone of 45° and consisting of a front section reducing in radius at a relative high rate, a middle section reducing in radius at a relative low rate, and a rear section reducing in radius at a relatively high rate.

8. The rotary valve operating mechanism according to claim 6, wherein said engine is a 4-stroke cycle engine and said first dwell cam surface portion is a concentric circular cam surface of a relatively small radius extending over a sector zone of 135°, said rise cam surface portion extending over a sector zone of 45° and consisting of a front section increasing in radius at a predetermined rate, a middle section of uniform radius, and a rear section increasing in radius at a predetermined rate, and wherein said second dwell cam surface portion is a concentric circular cam surface of a relatively large radius extending over a sector zone of 135°, said return cam surface portion extending over a sector zone of 45° and consisting of a front section reducing in radius at a predetermined rate, a middle section of uniform radius, and a rear section reducing in radius at a predetermined rate.

9. The rotary valve operating mechanism according to claim 8, wherein said drive means further comprises a pinion gear installed on said rotary valve to rotate with same, said rocker arm being swingably supported at a portion intermediate its opposite ends and having at one of said ends a roller in rolling contact with said cam and at the other of said ends a sector gear meshed with said pinion gear.

10. A rotary valve operating mechanism for an internal combustion engine comprising:

a rotary valve rotatable about an axis and having a valve port extending crosswise of said axis; and drive means for driving said rotary valve in such a way that said rotary valve is oscillatable through a predetermined angle to sequentially open and close a port of the engine communicating with a combustion chamber when driven in one direction.

11. The rotary valve operating mechanism according to claim 10, wherein said predetermined angle is about 180°.

12. The rotary valve operating mechanism according to claim 10, wherein said predetermined angle is between 135° and 225°.

* * * * *